United States Patent [19]

Annis

[11] 4,207,876

[45] Jun. 17, 1980

[54] COMPRESSION DEVICE WITH VENTILATED SLEEVE

[75] Inventor: Larry D. Annis, Elgin, Ill.

[73] Assignee: The Kendall Company, Boston, Mass.

[21] Appl. No.: 2,826

[22] Filed: Jan. 12, 1979

[51] Int. Cl.[2] ..... A61H 1/00

[52] U.S. Cl. ..... 128/24 R

[58] Field of Search ..... 128/24 R, 38–40, 128/60, 64, 33, 82.1, DIG. 20, DIG. 15, DIG. 23

[56] References Cited

U.S. PATENT DOCUMENTS

| | | | |
|---|---|---|---|
| 3,920,006 | 11/1975 | Lapidus | 128/40 X |
| 4,013,069 | 3/1977 | Hasty | 128/24 R |
| 4,029,087 | 6/1977 | Dye et al. | 128/24 R |
| 4,030,488 | 6/1977 | Hasty | 128/24 R |
| 4,091,804 | 5/1978 | Hasty | 128/24 R |

*Primary Examiner*—Lawrence W. Trapp

*Attorney, Agent, or Firm*—Powell L. Sprunger

[57] ABSTRACT

A device for applying compressive pressures against a patient's limb from a source of pressurized fluid. The device has an elongated pressure sleeve for enclosing a length of the patient's limb, with the sleeve having a plurality of laterally extending separate fluid pressure chambers progressively arranged longitudinally along the sleeve from a lower portion of the limb to an upper portion of the limb proximal the patient's heart relative to the lower portion. The sleeve has a plurality of laterally extending ventilation channels located intermediate different pairs of adjoining compression chambers and having openings for facing the patient's limb. The sleeve also has a connecting channel extending along the side of the pressure chambers and communicating with the ventilation channels. The device also has a control assembly for intermittently inflating and deflating the pressure chambers and for passing air into the ventilation channels to ventilate the patient's limb through the openings.

6 Claims, 9 Drawing Figures

FIG. 1
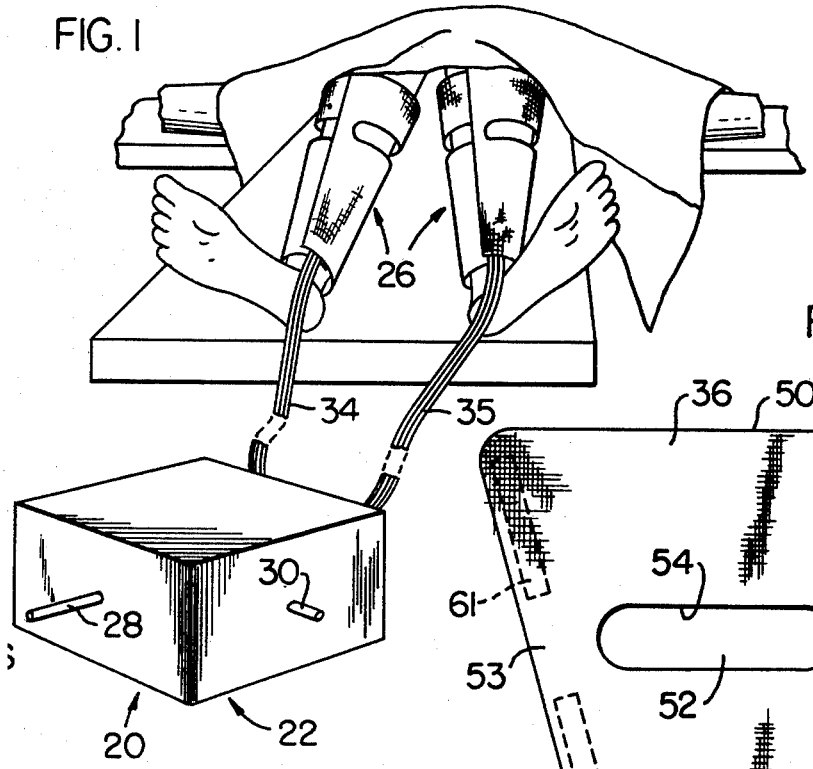
FIG. 2
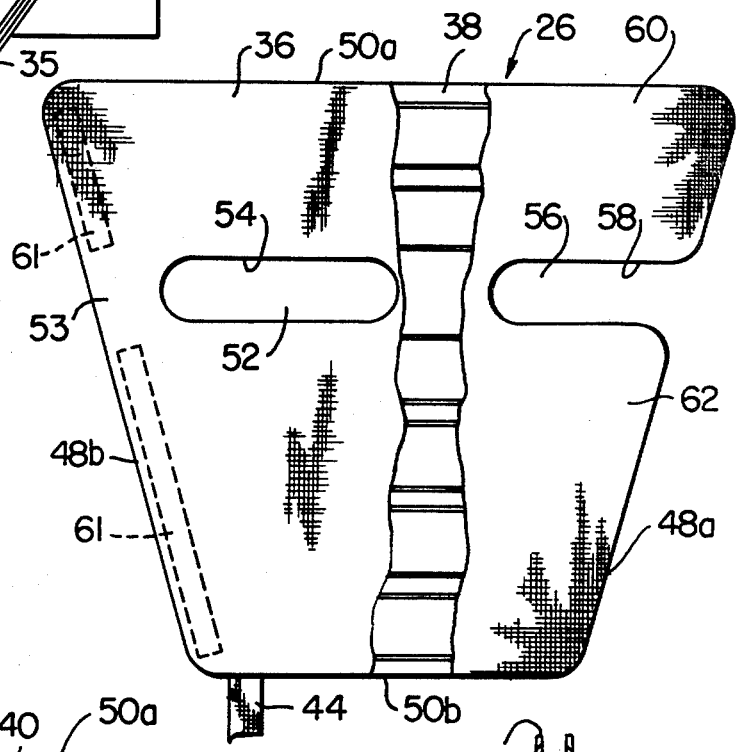
FIG. 3
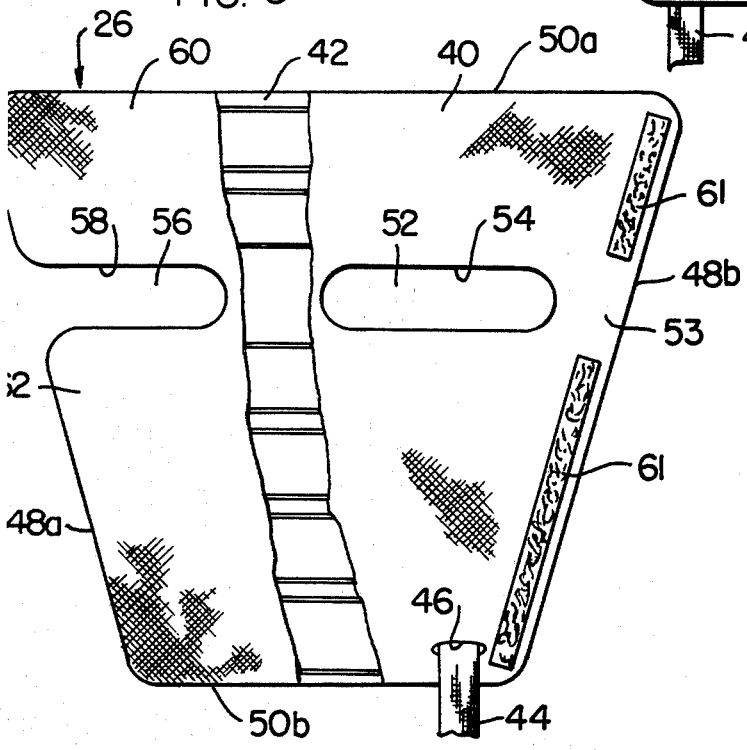
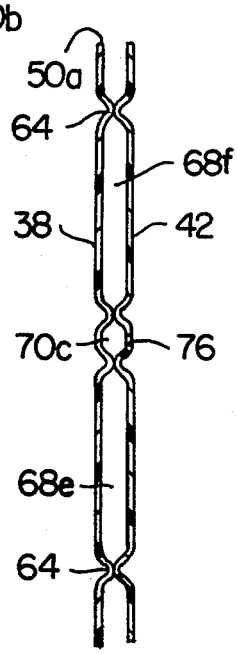
FIG. 8

FIG. 6
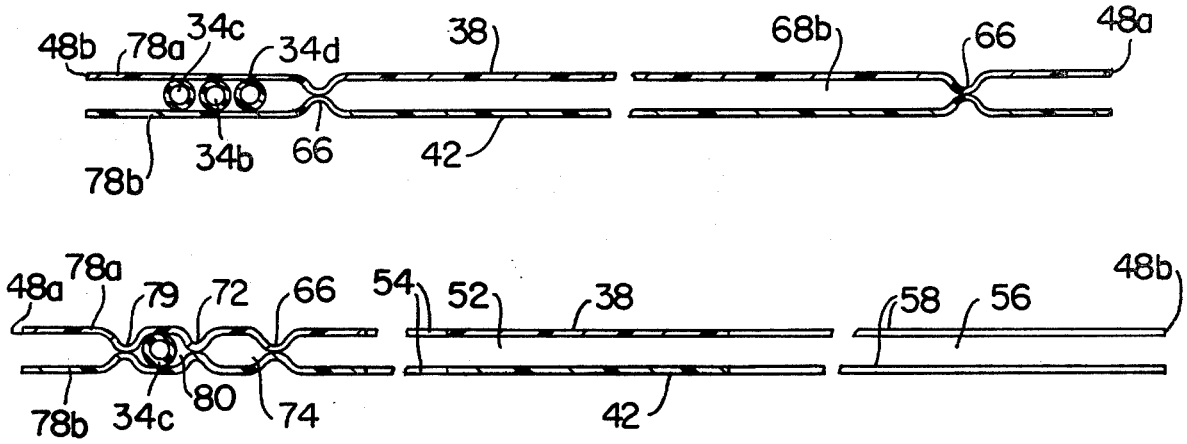
FIG. 7
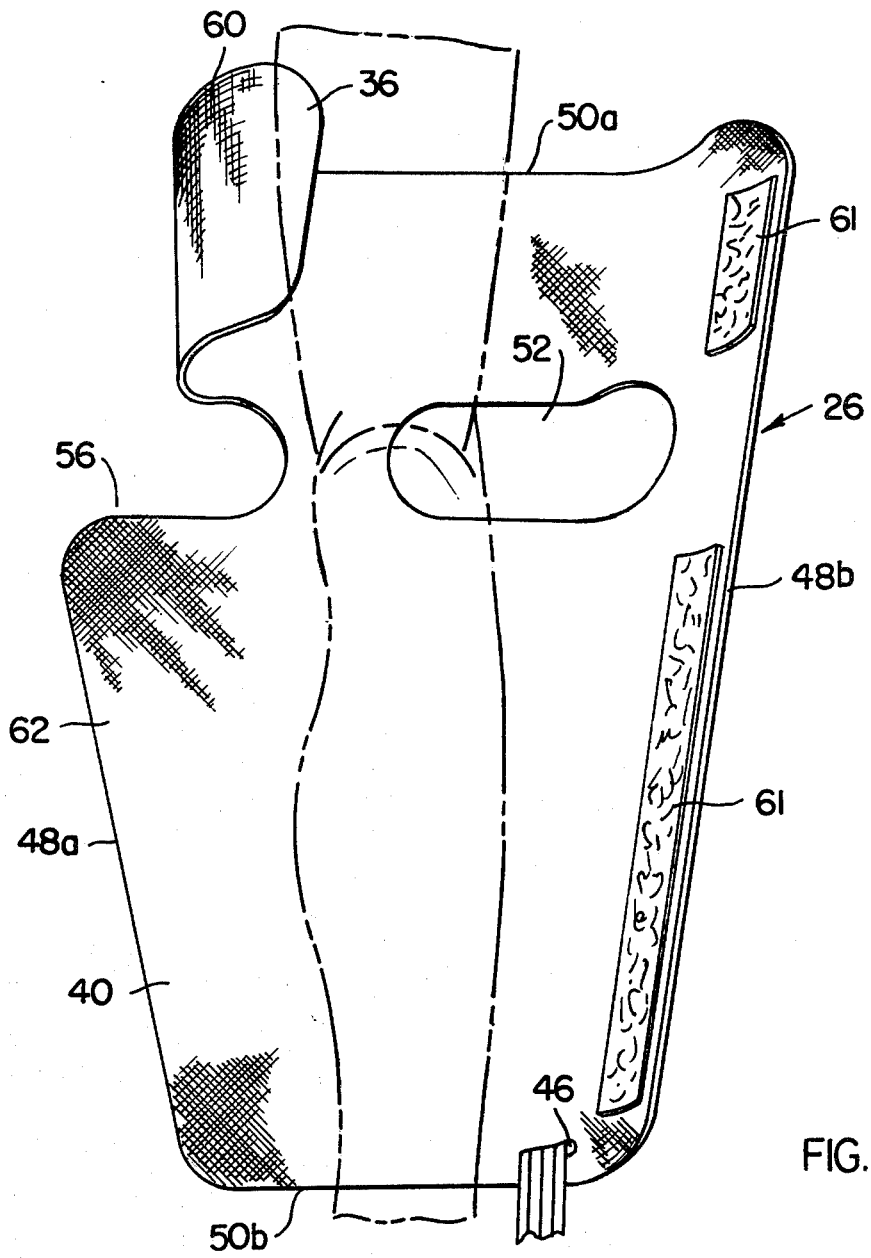
FIG. 9

COMPRESSION DEVICE WITH VENTILATED SLEEVE

BACKGROUND OF THE INVENTION

The present invention relates to therapeutic and prophylactic devices, and more particularly to devices for applying compressive pressures against a patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

Devices have been disclosed in U.S. Pat. Nos. 4,013,069 and 4,030,488, incorporated herein by reference, which develop and apply the desired compressive pressures against the patient's limbs. Such devices comprise a pair of sleeves which envelope the patient's limbs, and a controller for supplying fluid pressure to the sleeves. It has been found that the sleeves cause an uncomfortable build up of heat about the patient's limbs during extended use, since the sleeves essentially close the limbs from the atmosphere. One solution to this problem was proposed in U.S. Pat. No 4,091,804, incorporated herein by reference, through ventilation of the legs in the knee region. It is preferred that the air be distributed substantially throughout the length of the limbs. However, it has been found difficult to accomplish this result without excessive complication in the sleeve structure due to the size and volume needed for the compression chambers in the sleeve, and the multiple number of air supply lines apparently required at various locations on the sleeve.

SUMMARY OF THE INVENTION

A principal feature of the present invention is the provision of a device of simplified construction for applying compressive pressures against a patient's limb.

The device of the present invention comprises, an elongated pressure sleeve for enclosing a length of the patient's limb, with the sleeve having a plurality of laterally extending separate fluid pressure chambers progressively arranged longitudinally along the sleeve from a lower portion of the limb to an upper portion of the limb proximal the patient's heart relative to the lower portion. The sleeve has ventilation means comprising a plurality of laterally extending ventilation channels having a width substantially less than the width of the chambers, with the ventilation channels having opening means for facing the patient's limb. The device has control means for intermittently inflating and deflating the pressure chambers and for passing air to the ventilation channels.

A feature of the present invention is that the ventilation channels are located intermediate different pairs of adjoining chambers such that they are spaced along a substantial length of the sleeve.

Thus, a feature of the invention is that the sleeve provides an improved distribution of air for ventilation of the patient's limbs.

Yet another feature of the invention is that the ventilation channels have a relatively small width such that they do not detract from the size and volume required by the pressure chambers.

A further feature of the invention is that the sleeve has a connecting channel extending along the side of the pressure chambers and communicating with the ventilation channels.

Thus, a feature of the invention is that the air may be supplied from the control means to the connecting channel in order to distribute the air throughout the plural ventilation channels.

Still another feature of the invention is that the control means may supply air to the ventilation means during the period of time when the chambers are deflated.

Yet another feature of the invention is the provision of means for selectively permitting and preventing the passage of air from the control means to the ventilation means.

Further features will become more fully apparent in the following description of the embodiments of this invention and from the appended claims.

DESCRIPTION OF THE DRAWINGS

In the drawings:

FIG. 1 is a fragmentary perspective view of a compression device of the present invention;

FIG. 2 is a front plan view, partly broken away, of a compression sleeve for the device of FIG. 1;

FIG. 3 is a back plan view, partly broken away, of the sleeve of FIG. 2;

FIG. 6 is a fragmentary sectional view taken substantially as indicated along the line 6—6 of FIG. 4;

FIG. 7 is a fragmentary sectional view taken substantially as indicated along the line 7—7 of FIG. 4;

FIG. 8 is a fragmentary sectional view taken substantially as indicated along the line 8—8 of FIG. 4; and FIG. 9 is a perspective view illustrating the sleeve during placement on a patient's leg.

DESCRIPTION OF THE PREFERRED EMBODIMENTS

Figure 4:
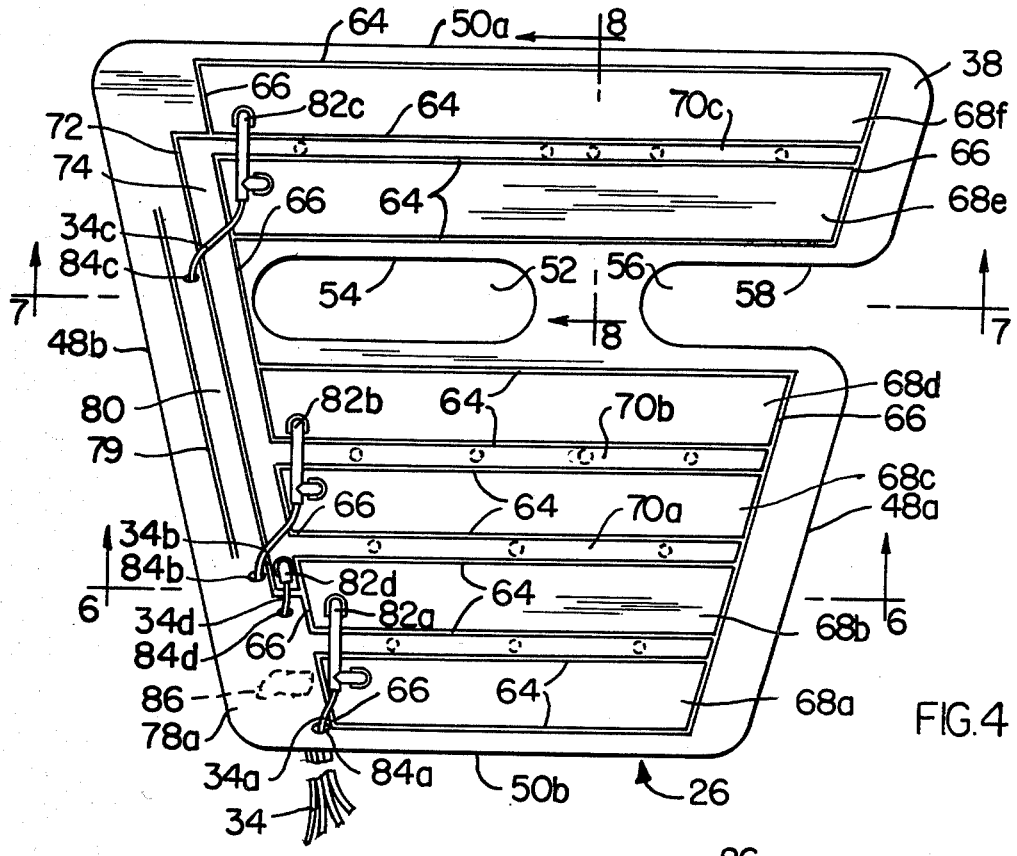
FIG. 4 is a front plan view of fluid impervious sheets defining chambers in the sleeve of FIG. 2.

Referring now to FIG. 1, there is shown an intermittent compression device generally designated 20 having a controller 22, and a pair of elongated compression sleeves 26 for enclosing a length of the patient's extremities, such as the legs as shown. The controller 22 is connected through a tube 28 to a source S of pressurized gas, and to an exhaust tube 30. Also, the controller 22 is connected to the separate sleeves 26 through separate sets of conduits 34 and 35. The controller may be of any suitable type, such as the controllers described in U.S. Pat. Nos. 4,013,069 and 4,030,488.

With reference to FIGS. 2 and 3, the sleeve 26 has an outer cover sheet 36 covering the entire outer surface of an outer fluid impervious barrier sheet 38. Also, the sleeve 26 has an inner cover sheet 40 covering an inner surface of an inner fluid impervious barrier sheet 42. The outer cover sheet 36 may comprise a relatively inelastic fabric with a brushed matte or napped finish of nylon or polyester, such as a fabric sold under the trademark Flannel/Flannel II, No. 11630, by Guilford Mills, Greensboro, North Carolina, which provides an attractive outer surface for the sleeve, and also defines brushed or napped fibers across the entire outer surface of the sleeve for a purpose which will be described below. In suitable form, the fabric of the sheet 36 may be warp knit from polyester yarns on a tricot machine, after which the fabric is dyed to a suitable color, and the fabric is brushed or napped on a suitable machine to raise loops from the fabric. The inner cover sheet 40 may comprise a suitable nonwoven material which provides a comfortable inner surface of the sleeve for the patient. The barrier sheets may be formed from a suitable flexible plastic material, such as polyvinylchloride. If desired, a segment of the brushed nylon fabric may be formed into a tube 44 to cover the conduits which extend from the sleeve to the controller. As shown, the conduits and covering tube 44 may extend through an opening 46 in the inner cover sheet 40.

The sleeve 26 may have a pair of side edges 48*a* and 48*b*, and a pair of end edges 50*a* and 50*b* connecting the side edges 48*a* and *b*, with the side edges 48*a* and *b* being tapered toward a lower end of the sleeve. The sleeve 26 may also have an elongated opening 52 extending through a knee region 53 of the sleeve, and defined by peripheral edges 54 extending around the opening 52. In addition, the sleeve 26 has an elongated opening or cut-out 56 in the knee region 53 extending from the side edge 48*a* toward a lateral central portion of the sleeve, with the opening 56 being defined by peripheral edges 58 extending from the side edge 48*a* around the opening 56. As shown, the inner end of the opening 56 is spaced from the opening 54, and the opening 56 defines an upper flap 60 and a lower flap 62 of the sleeve which are separated by the opening 56. Further, the sleeve 26 may have a pair of lower fastening strips 61, such as a hook material sold under the trademark Velcro, secured to the inner cover sheet 40 long the side edge 48*b*.

Figure 5:
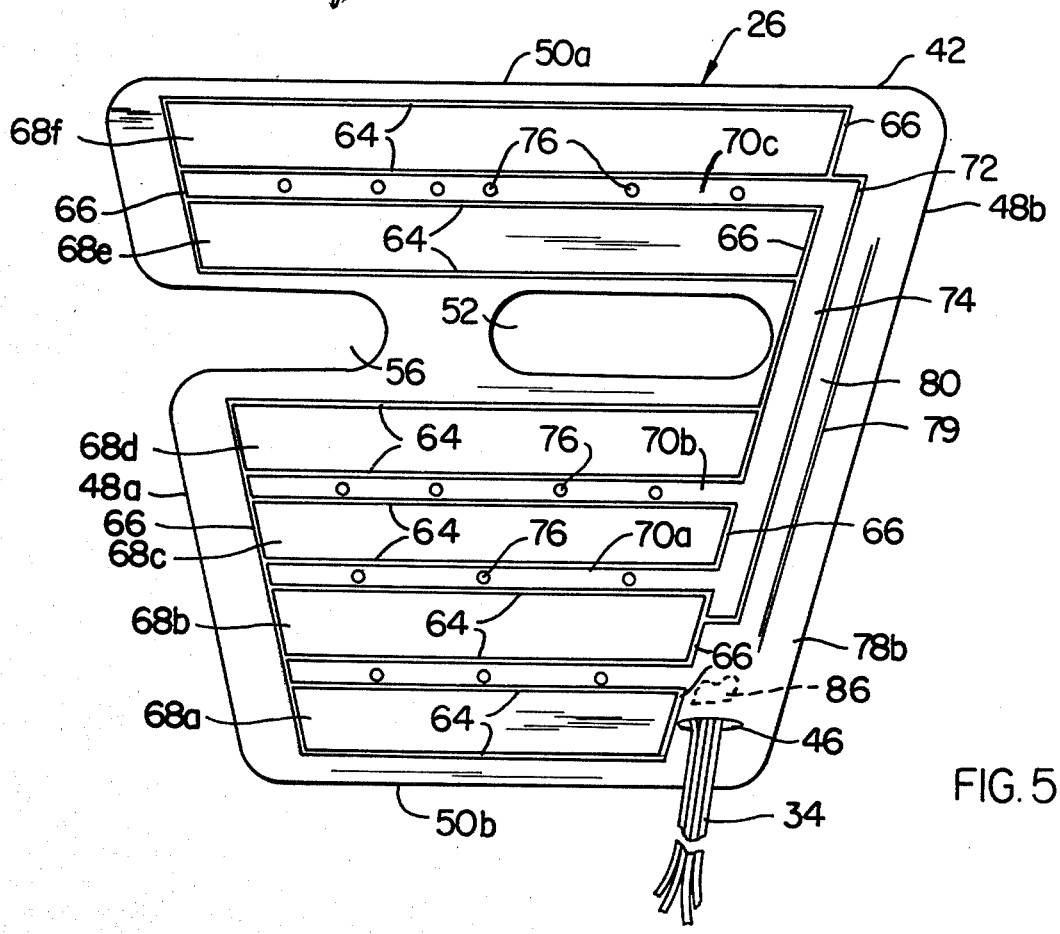
FIG. 5 is a back plan view of the fluid impervious sheets of FIG. 4.

With reference to FIGS. 4–8, the inner and outer fluid impervious barrier sheets 38 and 42 have a plurality of laterally extending lines 64, such as lines of sealing, connecting the barrier sheets 38 and 42 together, and longitudinally extending lines 66, such as lines of sealing, connecting the sheets 38 and 42 together and connecting ends of the lateral lines 64, as shown. The connecting lines 64 and 66 define a plurality of longitudinally disposed chambers 68*a*, 68*b*, 68*c*, 68*d*, 68*e*, and 68*f*, which for convenience will be termed contiguous. As shown, the chambers 48 extend laterally in the sheets 38 and 42, and are disposed in the longitudinal arrangement between the end edges 50*a* and 50*b*. When the sleeve is placed on the patient's leg, the lowermost chamber 68*a* is located on a lower part of the leg adjacent the patient's ankle, while the uppermost chamber 68*f* is located on an upper part of the leg adjacent the midthigh.

As shown, the longitudinal line 66 nearest the side edge 48*b* is separated intermediate the chambers 68*b* and *c*, 68*c* and *d*, and the chambers 68*e* and *f*. The lateral lines 64 define ventilation channels 70*a*, 70*b*, and 70*c* extending laterally in the sleeve from the longitudinal line 66 adjacent the side edge 48*a* toward the longitudinal lines 66 adjacent the side edge 48*b*, with the ventilation channels 70 being positioned at spaced locations longitudinally along the sleeve intermediate different pairs of adjoining chambers. Thus, the ventilation channel 70*a* is located intermediate the chambers 68*b* and 68*c*, the ventilation channel 70*b* is located intermediate the chambers 68*c* and 68*d*, and the ventilation channel 70*c* is located intermediate the chambers 68*e* and 68 *f*. Moreover, the ventilation channels 70 have a width substantially less than the width of the chambers 68 such that the channels 70 do not detract from the size and volume required for the compression chambers 68. The inner and outer barrier sheets 38 and 42 also have a longitudinally extending line 72 which defines a connecting channel 74 intermediate the line 72 and the adjacent longitudinal line 66. As shown, the connecting channel 74 extends along the sides of the chambers 68*c*, 68*d*, and 68*e*, and communicates with the ventilation channels 70*a*, *b*, and *c*, such that the channel 74 connects the spaced ventilation channels 70. Further, the inner barrier sheet 42 has a plurality of openings or apertures 76 which communicate with the channels 70. Thus, when the sleeve 26 is placed on the patient's leg, the openings 76 face toward the leg.

With reference to FIGS. 4–7, the longitudinal lines 66 and 72 adjacent the side edge 48*b* define a pair of flaps 78*a* and 78*b* of the barrier sheets 38 and 42 which extend between the respective lines and the side edge 48*b*. As shown, the sheets 38 and 42 have a longitudinally extending line 79 which defines a directing channel 80 intermediate the lines 79 and 72, with the opposed longitudinal ends of the channel 80 being open. The sleeve 26 has a first connecter 82*a* which is commonly connected in fluid communication to the two lowermost chambers 68*a* and 68*b*, and which is connected to a conduit 34*a* in the illustrated conduit set 34. As shown, the conduit 34*e* passes through an opening 84*a* in the upper barrier sheet flap 78*a* which retains the conduit 34*a* at the desired position in the sleeve 26. The sleeve 26 also has a second connecter 82*b* which is commonly connected in fluid communication to the second pair of adjoining chambers 68*c* and 68*d*, and which is connected to a second conduit 34*b* in the conduit set 34. The conduit 34*b* passes through an opening 84*b* in the upper flap 78*a* which retains the conduit 34*b* at the desired position. The sleeve 26 has a third connecter 82*c* which is commonly connected in fluid communication to the uppermost chambers 68*e* and 68*f*, and which is connected to a third conduit 34*c* in the conduit set 34. As shown, the conduit 34*c* passes through an opening 84*c* in the upper flap 78*a*, with the conduit 34*c* extending through the directing channel 80 in order to retain the third conduit 34*c* at the desired position in the sleeve. The sleeve 26 also has a fourth connecter 82*d* which is connected in fluid communication to the connecting channel 74 in order to permit passage of air to the ventilation channels 70. As shown, the connecter 82*d* is connected to a fourth conduit 34*d* in the conduit set 34, with the conduit 34*d* passing through an opening 84*d* in the upper barrier flap 78*a*. Thus, the conduits 34*a*, 34*b*, and 34*c* are separately connected to pairs of adjoining chambers, while the conduit 34*d* is connected to the connecting channel 74. Of course, the other sleeve associated with the conduits 35 may be constructed in a similar manner. It will be apparent that the barrier flaps 78*a* and 78*b*, the directing channel 80, and the openings 84 cooperate to retain the conduits at the desired position within the sleeve. Further, the sleeve 26 has suitable securing means 86, such as regions of heat sealing or adhesive, bonding the flaps 78*a* and 78*b* to opposed sides of the conduits 34 adjacent the opening 46. Thus, in the event that forces are applied to the conduits 34 exterior the sleeve 26, the forces are transmitted to the flaps 78*a* and *b* rather than the connectors 82*a*, *b*, and *c*, in order to relieve possible strain from the connectors and prevent severance of the connectors from the sleeve.

In use, the sleeve 26 may be placed below the patient's leg preparatory to securement about the limb, as illustrated in FIG. 9. Next, the upper flap 60 and lower flap 62 may be independently passed around the patient's leg at locations above and below the knee, respectively. Thus, the opening 56 separates the flap portions of the sleeve in the region of the knee to permit independent wrapping of the upper and lower portions of the sleeve about the leg and simplify placement of the sleeve, as well as provide an improved fit. After both the upper and lower flaps 60 and 62 have been suitably wrapped about the patient's limb, the remaining part of the sleeve adjacent the side edge **48*b* may be wrapped over the flaps 60 and 62, and the fastening strips 61 may be pressed against the outer cover sheet 36. Thus, the hook fastening strips 61 engage with the brushed fibers of the outer cover sheet 36, such that the strips 61 and sheet 36 interengage and retain the sleeve in the wrapped configuration. Since the sheet 36 extends entirely across the outer surface of the sleeve 26, the sleeve may be readily adjusted as necessary for the desired fit according to the size of the patient's leg. Thus, the sleeve 26 may be place in a simplified manner while accomplishing an improved fit on patients having varying leg sizes. In addition, the openings 52 and 56** greatly reduce the amount of material and bulk for the sleeve in the region of the patient's knee, Accordingly, the sleeve provides flexibility in the knee region in order to prevent binding and permit flexation of the knee during the extended periods of time while the sleeve is secured about the leg.

After placement of the sleeves on the patient's limbs, the controller 22 may be initiated in order to supply air to the sleeves 26. The controller 22 intermittently inflates the chambers 68 during periodic compression cycles, and intermittently deflates the chambers 68 through the exhaust tube 30 during periodic decompression cycles intermediate the compression cycles. The inelastic cover sheet 36 of the placed sleeve restricts the size of the inflated chambers, and greatly enhances the compressive action of the chambers to permit lower fluid volumes during the compression cycles. Further, the controller 22 supplies air through the conduits to the connecting channels 74 in the two sleeves. The air then passes from the common connecting channels 74 to the spaced ventilation channels 70 and through the openings 76 onto the patient's legs. In this manner, the device 20 ventilates a substantial portion of the patient's legs to prevent heat buildup and provide comfort for the patient during extended periods of time while the sleeves are retained in a wrapped condition about the patient's limbs. In a preferred form, the controller 22 supplies air to the ventilation channels 70 during the periodic decompression cycles. Also, the controller 22 may have suitable means, such as a switch, to selectively permit passage of air to the ventilation channels 70 or prevent passage of air to the ventilation channels 70, as desired. In addition, the switch may be utilized to control the quantity of air which ventilates the patient's limbs for maximum patient comfort.

The foregoing detailed description is given for clearness of understanding only, and no unnecessary limitations should be understood therefrom, as modifications will be obvious to those skilled in the art.

I claim:

1. A device for applying compressive pressures against a patient's limb from a source of pressurized fluid, comprising:

an elongated pressure sleeve for enclosing a length of the patient's limb, said sleeve having a plurality of laterally extending separate fluid pressure chambers progressively arranged longitudinally along the sleeve from a lower portion of the limb to an upper portion of the limb proximal the patient's heart relative to said lower portion, and ventilation means comprising a plurality of laterally extending ventilation channels having a width substantially less than the width of said chambers, with said ventilation channels having opening means for facing the patient's limb, and with said ventilation channels being located intermediate different pairs of adjoining pressure chambers, and said ventilation means having a connecting channel extending along the side of said pressure chambers and communicating with said ventilation channels; and control means for intermittently inflating and deflating said pressure chambers and for passing air into the ventilation means to ventilate the patient's limb through said opening means.

2. The device of claim 1 wherein said control means inflates said compression chambers during periodic compression cycles and deflates the chambers during periodic decompression cycles between said compression cycles.

3. The device of claim 2 wherein the control means passes air into the ventilation means during the decompression cycles.

4. The device of claim 1 wherein the control means includes means for selectively permitting and preventing passage of air into the ventilation means.

5. The device of claim 1 wherein said ventilation chambers are spaced along a substantial distance of the patient's limb.

6. An elongated sleeve for applying compressive pressures against a patient's limb, comprising:

a pair of flexible sheets of fluid impervious material;

means for connecting said sheets together along lines defining a plurality of separate laterally extending inflatable pressure chambers progressively arranged longitudinally along the sleeve from a lower portion of the limb to an upper portion of the limb proximal the patient's heart relative to said lower portion and defining a plurality of laterally extending ventilation channels having a width substantially less than the width of said chambers, and a connecting channel communicating with the ventilation channels, with said ventilation channels being located between different pairs of adjoining pressure chambers and having opening means for facing the patient's limb, and with said connecting channel extending along the side of the inflatable pressure chambers; and means for releasably securing the sleeve about the patient's limb with said pressure chambers and ventilation channels encircling the limb.

* * * * *

Disclaimer 4,207,876.—*Larry D. Annis,* Elgin, Ill. COMPRESSION DEVICE WITH VENTILATED SLEEVE. Patent dated June 17, 1980. Disclaimer filed Dec. 6, 1985, by the assignee, *The Kendall Co.*

Hereby enters this disclaimer to all claims of said patent.

[*Official Gazette June 17, 1986.*]